US007870846B2

(12) United States Patent
Weissenborn et al.

(10) Patent No.: US 7,870,846 B2
(45) Date of Patent: Jan. 18, 2011

(54) METHOD AND DEVICE FOR ASCERTAINING ONE OR MORE STARTS OF COMBUSTION IN A CYLINDER OF AN INTERNAL COMBUSTION ENGINE FROM A PROVIDED CYLINDER-PRESSURE CURVE

(75) Inventors: Erik Weissenborn, Stuttgart (DE); Thomas Bossmeyer, Korntal-Muenchingen (DE)

(73) Assignee: Robert Bosch GmbH, Stuttgart (DE)

( * ) Notice: Subject to any disclaimer, the term of this patent is extended or adjusted under 35 U.S.C. 154(b) by 82 days.

(21) Appl. No.: 12/387,363

(22) Filed: May 1, 2009

(65) Prior Publication Data

US 2009/0301435 A1 Dec. 10, 2009

(30) Foreign Application Priority Data

Jun. 6, 2008 (DE) ..... 10 2008 002 261

(51) Int. Cl.
*F02P 5/153* (2006.01)

(52) U.S. Cl. ..... 123/435; 123/406.41; 123/406.42; 123/406.43; 73/114.16

(58) Field of Classification Search ..... 123/406.41, 123/406.42, 406.43, 435; 73/114.16, 114.17
See application file for complete search history.

(56) References Cited

U.S. PATENT DOCUMENTS 5,076,098 A * 12/1991 Miwa ..... 73/114.17
5,255,209 A * 10/1993 Krebs ..... 702/140
6,484,694 B2 * 11/2002 Thomas ..... 123/435
6,598,468 B2 * 7/2003 Zur Loye et al. ..... 73/114.06
6,840,218 B2 1/2005 Scholl et al.
7,347,185 B2 * 3/2008 Moriya et al. ..... 123/435
7,401,504 B2 * 7/2008 Sunwoo et al. ..... 73/114.04
7,610,139 B2 * 10/2009 Mizuno et al. ..... 701/102
2006/0116812 A1 * 6/2006 Akazaki et al. ..... 701/114
2007/0186905 A1 * 8/2007 Caretta et al. ..... 123/435

FOREIGN PATENT DOCUMENTS

DE 10 2004 033 072 7/2005
DE 10 2005 026 724 1/2006

OTHER PUBLICATIONS

Assanis, D. N. et al., "A Predictive Ignition Delay Correlation Under Steady-State and Transient Operation of a Direct Injection Diesel Engine," ASME-ICE Fall Technical Conference, Ann Arbor, Michigan, 1999, pp. 450-457.
Katrasnik, Tomaz et al., "A New Criterion to Determine the Start of Combustion in Diesel Engines," Journal of Engineering for Gas Turbines and Power, No. 4, pp. 928-933.

* cited by examiner

*Primary Examiner*—Erick Solis
(74) *Attorney, Agent, or Firm*—Kenyon & Kenyon LLP

(57) ABSTRACT

A method for determining a point in time of a start of combustion in a cylinder of an internal combustion engine includes: providing a base compression pressure model which gives a curve of a compression pressure in the cylinder as a function of the operating point; adjusting the base compression pressure model using measured cylinder pressures of at least one operating state of the internal combustion engine at points in time at which no combustion is taking place in the cylinder, in order to obtain an adjusted compression pressure model; and determining a point in time of a start of combustion with the aid of a pressure curve determined by the adjusted compression pressure model.

13 Claims, 6 Drawing Sheets

METHOD AND DEVICE FOR ASCERTAINING ONE OR MORE STARTS OF COMBUSTION IN A CYLINDER OF AN INTERNAL COMBUSTION ENGINE FROM A PROVIDED CYLINDER-PRESSURE CURVE

BACKGROUND OF THE INVENTION

1. Field of the Invention

The present invention in general relates to internal combustion engines, a start of combustion in a cylinder of the internal combustion engine being ascertained from a cylinder-pressure curve that is provided.

2. Description of Related Art

During operation of internal combustion engines, combustion is able to be controlled in the cylinders. For this purpose, however, an analysis is required of the combustion processes taking place in the cylinders. An analysis of the combustion is preferably carried out by an evaluation of the curve of a cylinder pressure in the cylinder being observed. From this one is able to derive the start of combustion in the cylinder.

The curve of the cylinder pressure may be used, for instance, for calculating the heat release development, which describes the heat release caused by the combustion. Results of the analysis of a combustion in the cylinder are, for instance, the indicated average pressure, the heat developed, the start of combustion, the end of combustion and the duration of combustion.

Methods are known, for instance, from published German patent document DE 102 004 033 072, which define the start of combustion in such a way that the heating curve or the cumulative heating curve exceeds a specified threshold, e.g. 5% of the overall heat liberated. However, a determination of the start of combustion cannot always be made without doubt from the heating curve, especially in the case of small injection quantities.

Among the abovementioned results of combustion analysis, the determination of the start of combustion represents an important measure for improving combustion control in the cylinders. In particular, the start of combustion detection is used for the following purposes:

1. The monitoring of the start of injection will be required in the future by legal regulations. Malfunctions of the injection system may be detected thereby, in which the system is not in a position of supplying fuel at a certain crankshaft angle that is necessary to keep pollutant emission at or below a specified level. From the start of combustion, the start of injection $\phi_{EB}=\phi_{BB}-\phi_{ZV}$ ($\phi_{EB}$: crankshaft angle of a start of injection, $\phi_{BB}$: crankshaft angle of a start of combustion, and $\phi_{ZV}$: crankshaft angle of an ignition delay) is able to be ascertained and monitored. This enables one to detect an injection that is too early ($\phi_{EB}<\phi_{EB_setpoint}$) or too late ($\phi_{EB}>\phi_{EB_setpoint}$). This assumes that the ignition delay $\phi_{ZV}$, which is a function of a parameter vector $\underline{\theta}$, is known sufficiently well or is calculated using an ignition delay model.

The deviations of the actual start of combustion from the setpoint start of combustion may be supplied to a controller which shifts the start of control for the injection valve or valves appropriately and/or displays a fault message to the driver and/or stores an appropriate information in a fault memory for diagnosis in the repair shop.
2. Furthermore, if the start of combustion is known, the ignition delay $\phi_{ZV}=\phi_{BB}-\phi_{EB}$ is able to be monitored. With that, changes in the cylinder charge (e.g. oxygen content or residual gas content, temperature) or the ignitability of the fuel (cetane number), which lead to a more rapid ($\phi_{ZV}<\phi_{ZV_setpoint}$) or a slower ($\phi_{ZV}>\phi ZV_{_setpoint}$) inflammation, are able to be detected and compensated for. This presumes that the start of injection $\tau_{EB}$ is known sufficiently well. Start of injection $\phi_{EB}$ may be calculated from the start of control and the injection delay (the elapsed time between the electrical control and the opening of the nozzle) ($\phi_{EB}=\phi_{AB}+\phi_{EV}\approx\phi_{AB}+n*\tau_{EV}$) ($\phi_{AB}$: crankshaft angle at start of control). Injection delay $\phi_{EV}$ is generally proportional to rotational speed n on the assumption of a constant injection delay in time ($\tau_{EV}\approx$constant). Deviations of the actual ignition delay from setpoint ignition delay $\phi_{ZV_setpoint}$ may be supplied to a controller which correspondingly adjusts operating parameters such as start of control, rail pressure or charge pressure and/or displays it to the driver (as a fault message) and/or stores it in a fault memory for diagnosis in the repair shop.
3. For regeneration in response to active exhaust gas aftertreatment, post-injections are used, among other things, whose purpose is to increase the exhaust gas temperature. Since those post-injections are able to reinforce an unfavorable thinning of oil on the cylinder wall, it is necessary to select the start of injection and the start of combustion as late as possible with respect to the temperature increase and as early as possible with respect to the extent of the thinning of the oil. This requires the regulation of the start of combustion to a defined point in time, which takes into account the divergent aims named above. For this purpose, a setpoint value that is a function of an operating point is generally determined for the start of combustion, to which the actual start of combustion is regulated.

Up to now, a series of possibilities has been known for determining the start of combustion from the cylinder pressure curve that is provided. The start of combustion generally corresponds to the first clear pressure increase in the cylinder, or is defined as the end of the pure compression phase in the cylinder.

One possibility of ascertaining the start of combustion from the cylinder pressure curve is to subdivide the cylinder pressure curve into a compression portion and a combustion portion and to derive from this the start of combustion. This is known, for example, from published German patent document DE 10 2005 026 724. It is described there that the cylinder pressure curve is recalculated to a logarithmic transformation curve shape.

The document of Assanis, D. N.; Filipi, Z. S.; Fiveland, S. B; Syrimis, M.: "A predictive ignition delay correlation under steady-state and transient operation of a direct-injection Diesel engine", ASME-ICE Fall Technical Conference, Ann Arbor, Mich., 1999, proposes the utilization of the maximum of the second derivative of the cylinder pressure curve as a criterion for the start of combustion. A similar procedure is described in the document of Katrasnik, T. et al., "A new criterion to determine the start of combustion in Diesel engines", Journal of Engineering for Gas Turbines and Power, No. 4, pp. 928-933, the authors favoring the maximum of the third derivative as the point in time of the start of combustion.

It is proposed in U.S. Pat. No. 6,840,218 to submit the cylinder pressure curve to a wavelet transformation which makes possible a temporal assignment of occurring frequencies.

A sudden increase in the absolute value of the wavelet coefficients is drawn upon, in this instance, as an indicator for the point in time of the start of combustion.

Methods which undertake a determination of the times of one or more starts of combustion, from the combustion curve or the heating curve, do not possess sufficient robustness for the secure detection of the ignition delay in the entire engine operating plane. Problems occur, above all, at working points having low injection quantities, as well as at signal interferences of the cylinder pressure signal. These problems are avoided in the above methods, which utilize the cylinder pressure signal directly.

It is an object of the present invention to provide a method and a device for ascertaining one or more starts of combustion from a provided cylinder pressure curve.

BRIEF SUMMARY OF THE INVENTION

According to a first aspect of the present invention, a method is provided for determining a point in time of a start of combustion in one cylinder of an internal combustion engine. The method includes the following steps:

- providing a base compression pressure model which gives a curve of a compression pressure in the cylinder as a function of the operating point;
- adjusting the base compression pressure model using measured cylinder pressures of at least one operating state of the internal combustion engine, at points in time at which no combustion is taking place in the cylinder, in order to obtain an adjusted compression pressure model; and
- determining a point in time of a start of combustion with the aid of a pressure curve determined by the adjusted compression model.
- Furthermore, the pressure curve determined by the adjusted compression pressure model is able to be used in a threshold value comparison, in order to determine a point in time of a start of combustion in the cylinder, as a function of a threshold value.

The above method is based on as exact as possible an ascertainment of a compression pressure curve from a base compression pressure model which describes an approximation of the compression pressure curve, by adjusting the compression pressure curve. The adjustment takes place with the aid of a cylinder pressure curve measured at an operating point, for the adjustment, the measured cylinder pressures being used only at crankshaft angles at which no combustion is taking place in the cylinder. Thus, the method is based on a working point-specific adjustment of the compression pressure curve.

The latter is subsequently drawn upon to ascertain the start of combustion, with the aid of a threshold value comparison. This makes possible the robust detection of the start of combustion of partial injections. Compared to known methods, better results are achieved particularly at operating points having very low energy conversion rates and at precombustions.

The method described above also supplies meaningful values for operating points at which no clear statements concerning the start of combustion are possible by the ascertainment of a combustion curve, because of several local maxima or too low a conversion rate.

Moreover, an adjusted differential pressure curve may be ascertained as a difference between the curve of the measured cylinder pressure and a compression pressure curve determined by the adjusted compression pressure model, and the differential pressure curve may be used in the threshold value comparison.

According to one example embodiment, a point in time of a start of precombustion may be determined by comparing the adjusted differential pressure curve to a precombustion threshold value, in order to determine the point in time of the start of precombustion as a function of the comparison to the precombustion threshold value.

According to another example embodiment, the point in time of the start of precombustion is ascertained as a local maximum of a curvature in the adjusted differential pressure curve, the local maximum being ascertained, for instance iteratively, starting from the point in time of the reaching or exceeding of the precombustion threshold value by the differential pressure curve.

Alternatively or in addition, a point in time of a start of combustion in the cylinder of the internal combustion engine, especially a start of main combustion, is able to be ascertained by determining the maximum of a curvature of the adjusted differential pressure curve, the pressure curve determined by the adjusted compression pressure model or the measured pressure curve. This is expedient especially if the start of precombustion has already been ascertained with the aid of the threshold value comparison.

Moreover, the point in time of the main combustion may be ascertained as the determined point in time of the global maximum of the curve of the curvature in the curve of the measured cylinder pressures.

Furthermore, a point in time of the start of afterburning in the cylinder of the internal combustion engine may be determined by comparing a differential pressure curve, which gives the difference between a provided cylinder pressure curve and a curve of the cylinder pressure according to a polytropic model, to a specified afterburning threshold value, in order to determine the point in time of the start of afterburning as a function of the afterburning threshold value.

According to one example embodiment, the polytropic model is able to be adjusted using the measured cylinder pressures of at least one operating state of the internal combustion engine at points in time at which the combustion in the cylinder has terminated, so as to obtain an adjusted polytropic model, the difference curve being ascertained with the aid of a curve of a modeled cylinder pressure according to the adjusted polytropic model.

Moreover, the base compression pressure model may be adjusted, using the provided cylinder pressure curve at the at least one operating state of the internal combustion engine, by taking into account during the adjustment, by the use of a selection matrix, only those cylinder pressures at the points in time at which no combustion is taking place in the cylinder, and at the times at which the differential pressure, determined from the provided cylinder pressure and the compression pressure determined by the adjusted compression pressure model, is less than a differential pressure threshold value.

In addition, the base compression pressure model may correspond to an overrun pressure model that describes the pressure curve in the cylinder during an overrun operation.

Because of this, using as accurate as possible an ascertainment of the overrun pressure, the base compression pressure model may be provided, so that the compression pressure curve is able to be determined by the subsequent working point-specific adjustment of this curve.

According to one further aspect, a device is provided for determining a point in time of a start of combustion in an internal combustion engine. The device is developed:

- in order to provide a base compression pressure model which gives a curve of a compression pressure in the cylinder of the internal combustion engine as a function of the operating point;
- in order to adjust the base compression pressure model using measured cylinder pressures of at least one operating state of the internal combustion engine at points in time at which no combustion is taking place in the cylinder, in order to obtain an adjusted compression pressure model; and in order to determine a point in time of a start of combustion in the cylinder with the aid of a pressure curve determined by the adjusted compression pressure model.

According to one additional aspect, a computer program is provided to carry out the above method, when the computer program is executed on a data processing device.

According to another aspect, a device arranged for program technology is provided, which is designed to execute the above computer program.

DETAILED DESCRIPTION OF THE INVENTION

Figure 1:
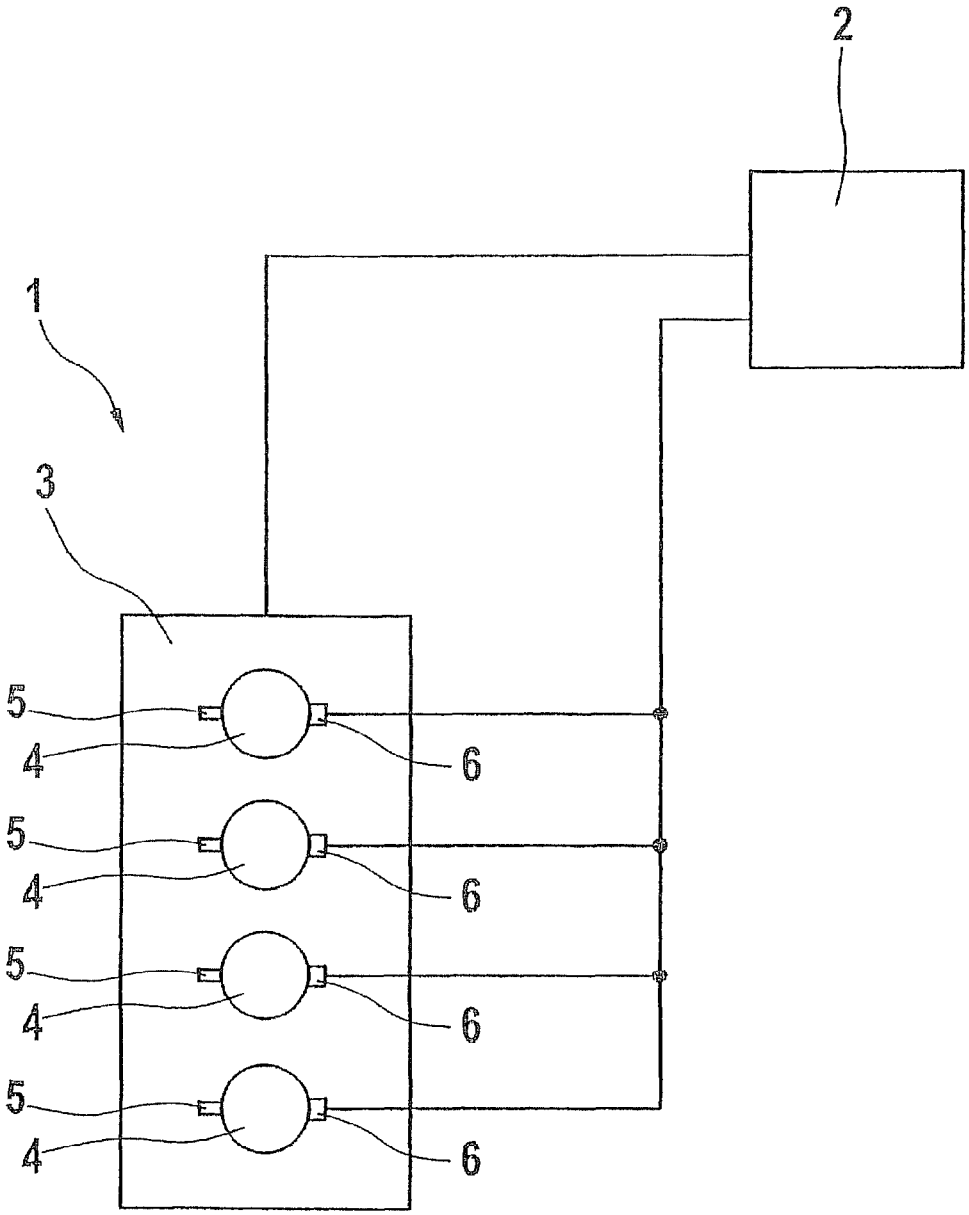
FIG. 1 shows a schematic representation of an engine system, in which the start of combustion is ascertained from the cylinder pressure curve.

FIG. 1 shows schematically an engine system 1, having an engine control unit 2 and an internal combustion engine 3. Engine control unit 2 is used for controlling or driving internal combustion engine 3. In the example shown, internal combustion engine 3 is developed to have four cylinders 4, into which fuel may be injected, controlled by engine control unit 2, via a respective injector 5. Internal combustion engine 3 is an internal combustion engine which is able to be operated at least partially in self-igniting operation, such as a Diesel engine.

One essential variable for improving the control of the combustion processes in cylinders 4 is represented by the point in time of the start of combustion of the main combustion, as well as the point in time of the start of combustion of the pilot injection, provided pilot injections are carried out.

In order to be able to determine starts of combustion, cylinder pressure sensors 6 are mounted in cylinders 4, in order to detect a curve of the respective cylinder pressure in cylinders 4. One cylinder pressure signal is transmitted in each case from a cylinder 4 to engine control unit 2.

In engine control unit 2, with the aid of the cylinder pressure curve detected in each cylinder, points in time of the starts of combustion in each cylinder 4 are ascertained as points in time of a significant increase in combustion pressure.

Figure 2:
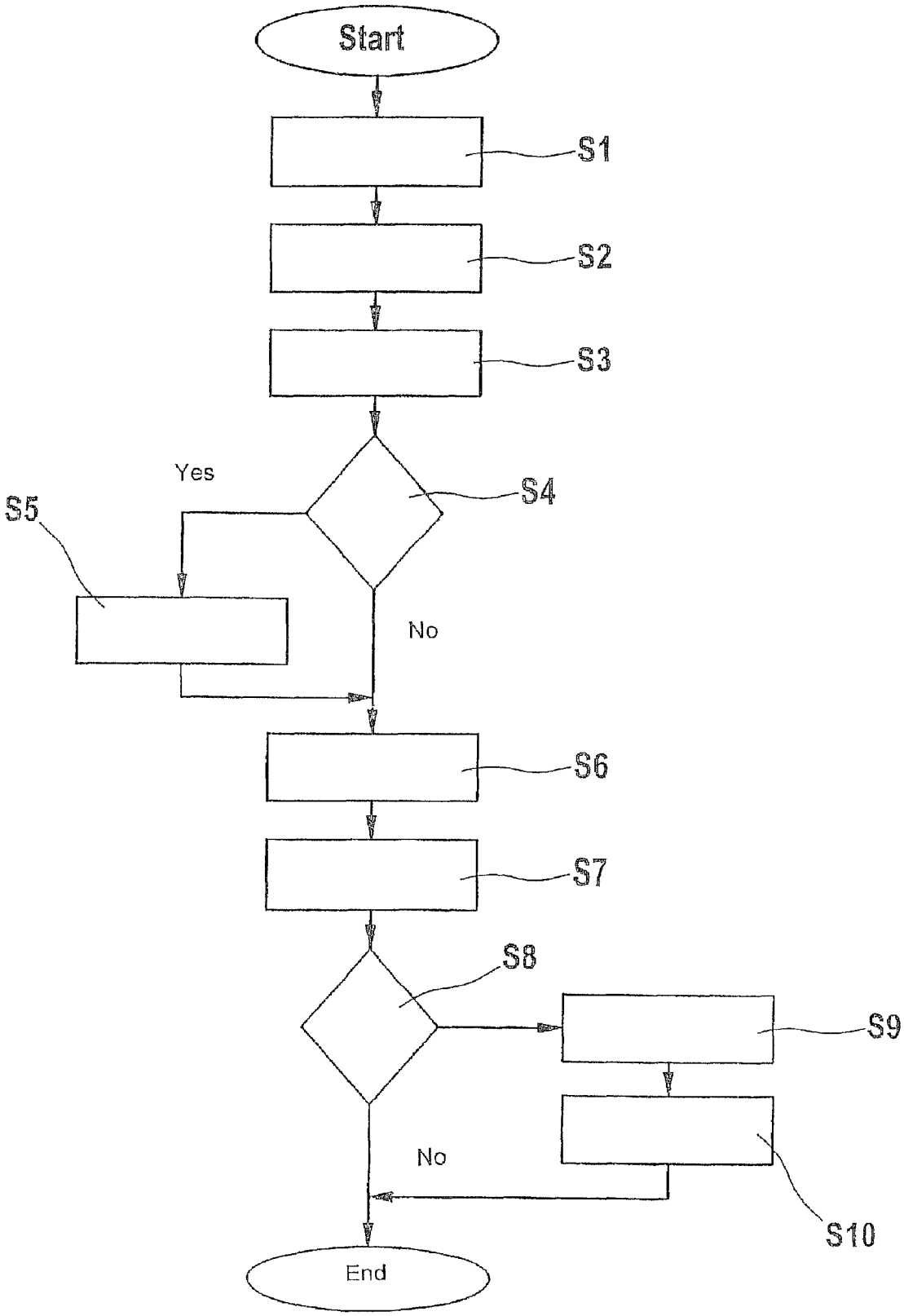
FIG. 2 shows a flow chart for illustrating the method for determining one or more starts of combustion from a provided cylinder pressure curve.

FIG. 2 shows a flow chart representing a method, using which the starts of combustion in particular cylinders 4 are able to be determined.

In particular, FIG. 2 shows a flow chart illustrating the method for determining the starts of precombustion, main combustion and afterburning in a selected one of cylinders 4. The method is carried out cyclically and generally takes into account the entire curve of the cylinder pressure over a crankshaft angle range in which the valves of cylinder 4 are closed.

During the carrying out of the method, the pressure in cylinder 4 is permanently measured in step S1, and is used to adjust a base compression pressure model provided previously in engine control unit 2 to the individual cylinder 4 of internal combustion engine 3, so as to obtain an adjusted compression pressure model. The adjustment takes place in a step S2.

Figure 3:
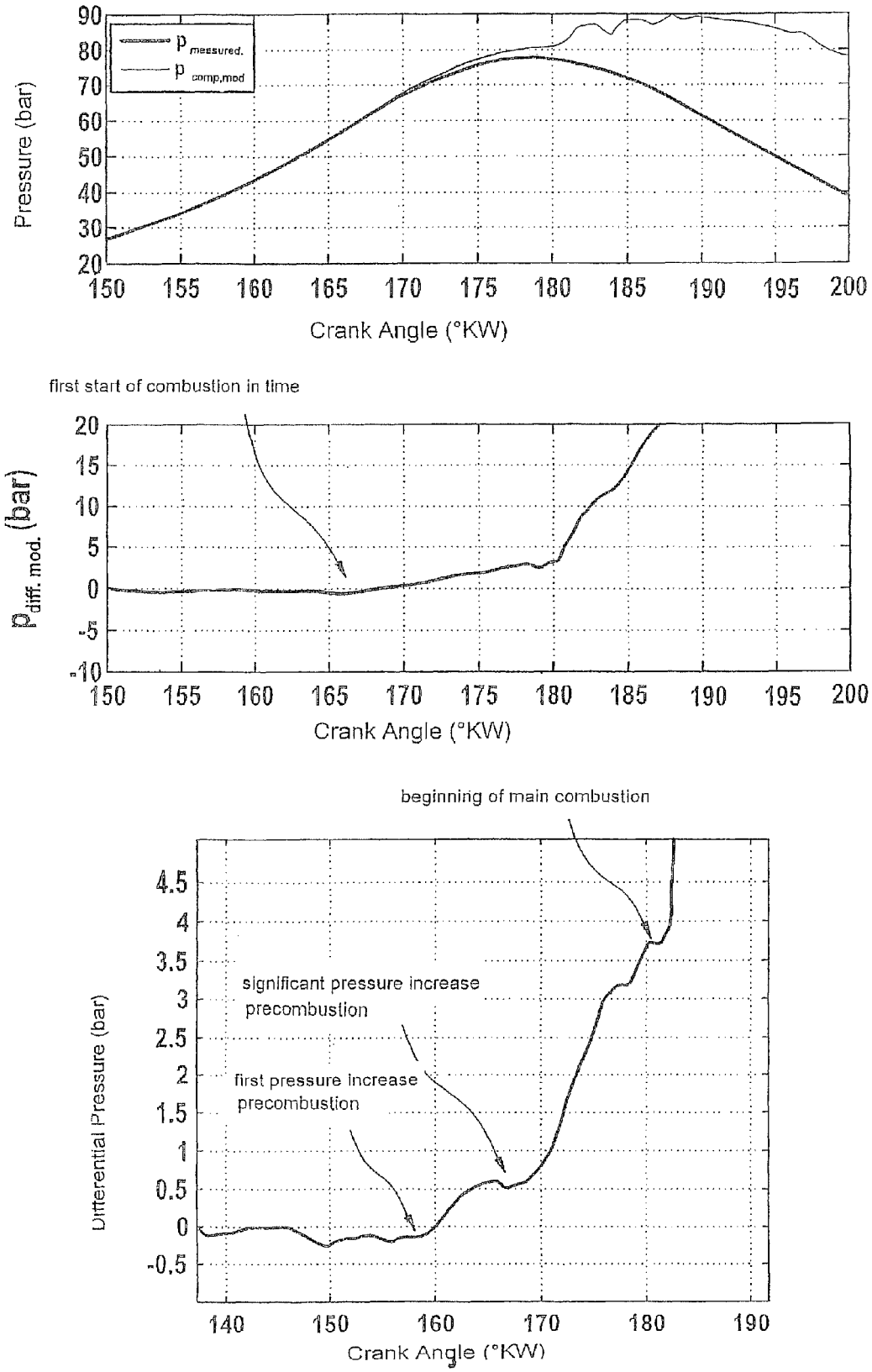
FIG. 3 shows a representation of a compression pressure curve according to the base compression pressure model, of the measured cylinder pressure curve, as well as of the modeled differential pressure plotted against the crankshaft angle.

In FIG. 3, the temporal curves of the measured cylinder pressure, of the compression pressure curve according to a provided base compression pressure model, as well as a differential pressure curve are shown as the difference of the cylinder pressure curve and the compression pressure curve. The bottom illustration shows the differential pressure curve in an enlarged representation. One may see a deviation of the measured cylinder pressure beginning at a crankshaft angle of ca. 160° KW.

The adjustment is necessary, since at working points having very low conversion of the injected fuel, the change in pressure brought about by combustion is very slight, so that, in response to a threshold value comparison, even in the case of slight model inaccuracies, greater deviations with respect to the detected crankshaft angles of the start of combustion may come about in the estimate of the differential pressure when there is a flat increase in pressure, for instance in the case of precombustion. Moreover, signal interferences in the pressure curve also lead to inaccuracies in the determination of the start of combustion.

The base compression pressure model provided at the beginning may correspond, for example, to an overrun pressure curve $p_{overrun}$. Overrun pressure curve $P_{overrun}$ may be measured for various rotational speeds and their curves may be stored accordingly in a characteristics map, and it corresponds to the pressure in a cylinder having closed valves and having no injection of fuel.

Alternatively, from the overrun pressure curves for various rotational speeds, parameters describing an overrun pressure model may be derived, which now makes possible the calculation of the overrun pressure curves for specific operating parameters. Additional possibilities are the calculation of the overrun pressure curve using a thermodynamic one-zone model or using simple polytropics or adiabats. The overrun pressure curve does not, as a rule, agree completely with the compression pressure curve in fired operation, since effects such as wall heat transfer occur in enhanced fashion because of the higher mass average temperatures. For this reason, an adjustment to the observed working point must take place, by estimating a parameter vector $\underline{\theta}$, using the method of least squares (LS).

$$\hat{\underline{\theta}}=(\underline{\underline{X}}^T\underline{\underline{X}})^{-1}\underline{\underline{X}}^T\underline{p}_{comp} \text{ with } \underline{\underline{X}}=\lfloor \underline{p}_{overrun}\underline{1} \rfloor$$

where $p_{comp}$ corresponds to a cylinder pressure measured in overrun pressure operation, where, as described below, only that range is taken into account in which no combustion takes place in the respective cylinder. The adjustment takes place only by scaling and shifting the model curve of the overrun pressure curve by a parameter vector $\hat{\underline{\theta}}$. Higher orders may be taken into account. However, these increase the degree of freedom too much, and may falsify the result. Therefore, parameter vectors of higher order are not expedient, as a rule. For the adjusted base compression pressure model, the following then applies:

$$p_{comp,mod}=\hat{\theta}_1 p_{overrun}+\hat{\theta}_2$$

The adjusted compression pressure $P_{comp,mod}$ (compression pressure curve), in the range between $\phi_{comp,start}$ to $\phi_{comp,end}$ has to agree with the measured pressure $p_{meas}$, that is $P_{meas}=p_{comp}$, with the following applying:

$$\phi_{comp,end}=\max(\phi_{EB,VV},150^\circ\text{ KW})$$

$$\phi_{comp,start}=\phi_{comp,end}-30^\circ\text{ KW}$$

In this phase, the pressure in the cylinder is determined exclusively by the compression pressure. The constant 30° KW describes the length of the window between $\phi_{comp,start}$ and $\phi_{comp,end}$. The values of 150° KW as start of the crankshaft range and 30° KW as the length of the crankshaft range are experiential values and may vary. Starts of combustion before 150° KW do not usually occur in current applications of conventional combustion.

One possibility of the fine adjustment of the ascertained compression pressure model may take place with the aid of a method of iterative, weighted least squares, in which a parameter vector $\hat{a}$ is determined, $$\underline{\hat{\alpha}}=(\underline{X}^T\underline{\underline{Q}}\underline{X})^{-1}\underline{X}^T\underline{\underline{Q}}\underline{p}_{means}\text{ with }\underline{X}=[\underline{p}_{comp,mod}\underline{1}]$$

$$p_{comp,mod*}=\hat{\alpha}_1 p_{comp,mod}+\hat{\alpha}_2$$

where $\underline{\underline{Q}}$ corresponds to a selection matrix and $p_{comp,mod}$ corresponds to the curve of a compression pressure according to the adjusted compression model.

The selection matrix is selected as follows:

As was described above, the adjusted compression pressure $P_{comp,mod}$ (compression pressure curve), in the range between $\phi_{comp,start}$ to $\phi_{comp,end}$ has to agree with the measured pressure $p_{meas}$, that is $p_{meas}=p_{comp}$, with the following also applying:

$$\phi_{comp,end}=\max(\phi_{EB,VV},150^\circ\text{ KW})$$

$$\phi_{comp,start}=\phi_{comp,end}-30^\circ\text{ KW}$$

Starts of combustion before 150° KW do not usually occur in current applications of conventional combustion. Therefore, in the selection matrix, the values that are in this range and are determined by the base compression pressure model are weighted with $Q_i=1$.

Furthermore, compression pressure $P_{comp,mod*}$ is not greater than the measured pressure at any angular value. For this reason, all positive errors $p_{comp,mod*}-p_{meas}>0$ are also weighted with $Q_i=1$.

Negative deviations $p_{comp,mod*}-p_{meas}<0$ may result from modeling errors or from an actual combustion. The angular value of the first significant pressure change is of particular interest. For this reason, negative deviations are weighted only to a certain limit at $Q_i=1$, and greater deviations correspondingly at $Q_i=0$. The limit that has met with success is the establishment of an absolute pressure limit of −1 bar, for example.

As a result of the calculation described above, values for $\hat{\alpha}_1$, and $\hat{\alpha}_2$ are obtained. The adjustment described above leads to lower deviations in the modeled compression pressure being equalized.

With the aid of the adjusted compression pressure model according to $P_{comp,mod*}$, determined above, the differential pressure $P_{diff}$ (° KW) may now be determined at each measured crankshaft angle in step S3:

$$p_{diff,mod*}p_{meas}-p_{comp,mod*}$$

It has been shown that, when the iterative, weighted least squares method is used, three to five iterations are sufficient for the adjustment of the base compression pressure model. In one alternative specific embodiment, the adjustment of the compression pressure model in step S2 may, of course, be carried out permanently or for a different number of steps.

Figure 4:
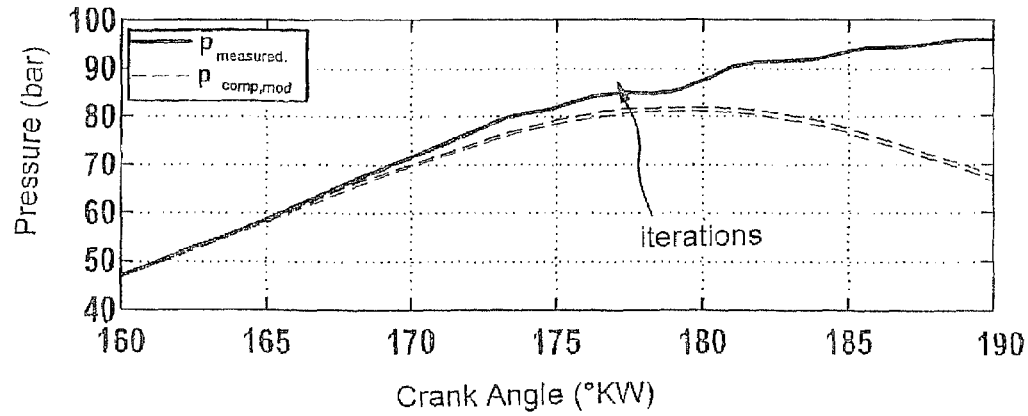
FIG. 4 shows a representation of the curve of the modeled compression pressure according to the adjusted compression pressure model, of the cylinder pressure curve as well as of the curve of the differential pressure according to the base compression pressure model and the adjusted compression pressure model, plotted against the crankshaft angle in the case of several iterations.
Figure 4:
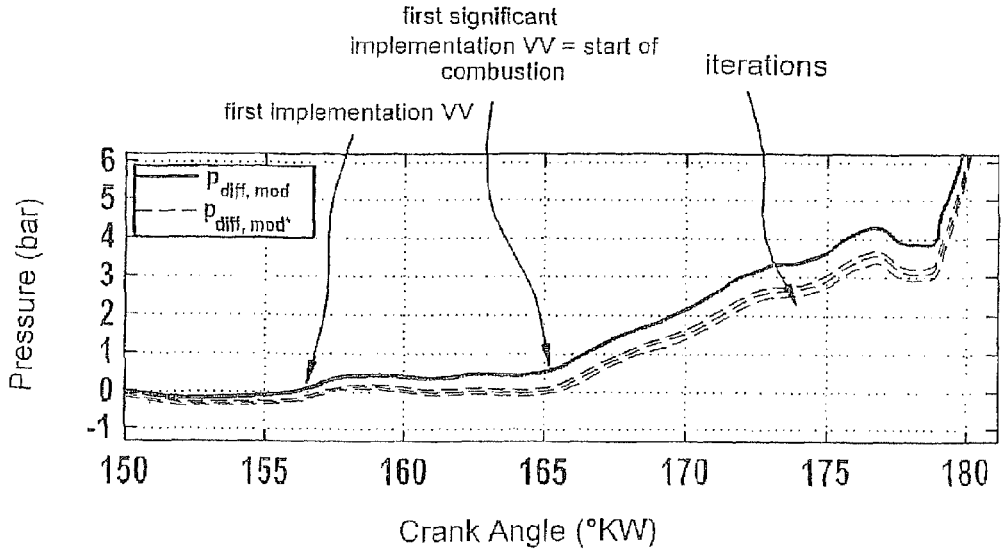

FIG. 4 shows the curves of measured cylinder pressure $p_{meas}$, the adjusted compression pressure curve $p_{comp,mod*}$, and the differential pressure curve $p_{diff,mod*}$ according to the adjusted compression pressure model. One may see the changes of the compression pressure model $p_{comp,mod*}$ from the fine adjustment of compression pressure model $p_{komp,mod}$ as a function of the iterations.

In step S4, it is determined whether a pilot injection is taking place in cylinder 4. If this is the case (alternative: yes), the ascertainment of the time of the start of combustion relates to a precombustion.

If the start of combustion of a precombustion is to be detected with the aid of an adjusted differential pressure curve, then, according to step S5, a precombustion threshold value is established which, in a precombustion, is able to be determined as a constant absolute pressure value, such as 0.25 bar, that applies for each working point. When the differential pressure curve exceeds the precombustion threshold value, this is assumed to be the point in time at which the precombustion is setting in.

The method of the above threshold value comparison based on adjusted compression pressure curve $p_{comp,mod}$ may also be applied to ascertaining the start of combustion of the main combustion. This applies especially if only one main combustion takes place, and no precombustion.

For all operating points of the combustion engine at which a pilot injection, generally meaning also a precombustion, has taken place, the start of combustion of the main combustion must additionally be gathered from estimated differential pressure curve $p_{diff,mod}$, that is, the differential pressure curve has to be gathered based on adjusted compression pressure model $p_{comp,mod}$. For this purpose, the feature of curve curvature $\kappa(\phi)$ is calculated (step S6), which permits a robust identification of the time of the start of combustion from the curve of differential pressure $p_{diff,mod}$. The following applies:

$$\kappa(\varphi)=\frac{p''_{diff,mod}(\varphi)}{(1+p'_{diff,mod}(\varphi)^2)^{3/2}}$$

Figure 5:
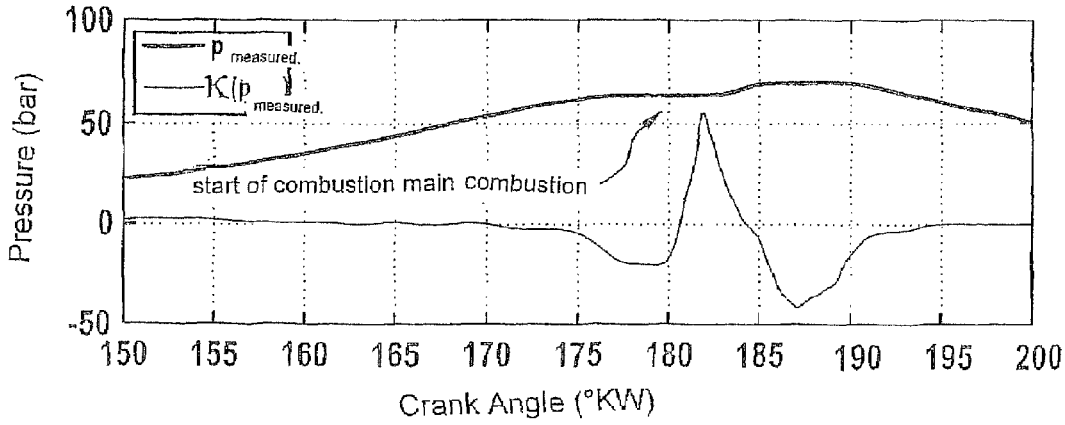
FIG. 5 shows a representation of the curves of the curvature for determining the start of combustion from the differential pressure curve and the measured cylinder pressure curve.
Figure 5:
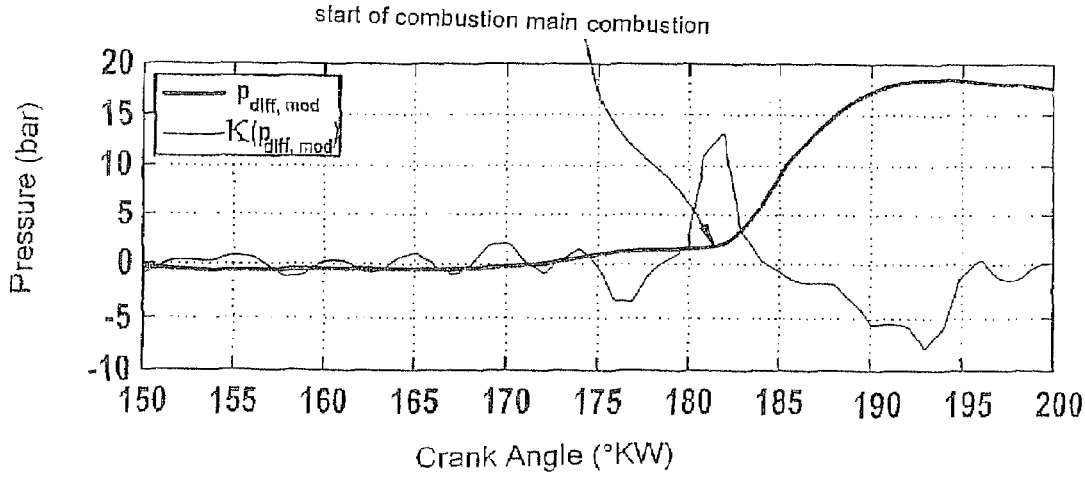

FIG. 5 shows the curves of the curvature with respect to the curves of measured cylinder pressure $p_{meas}$ and of differential pressure $p_{diff,mod}$ with respect to the base compression pressure model. As one may infer from FIG. 5, a clear maximum of curvature $\kappa(\phi)$ occurs in the range of the start of combustion of the main combustion. This may be ascertained by current methods in step S7, and utilized as a criterion for the point in time of the start of combustion.

In the following, it is checked whether afterburning takes place (step S8). In the case of a postinjection, fuel is injected after the approximately complete course of the main combustion. The time of the start of combustion of the subsequently situated postinjection is also ascertained from the differential pressure curve. At the start of injection of later than 40° KW after the top dead center, as a rule one may assume a nearly complete energy conversion of the main combustion. The differential pressure curve with respect to the adjusted compression pressure model $p_{diff,mod}$ in this range follows correspondingly, again approximately, a polytropic $p_{diff,poly}$.

For the purpose of ascertaining the start of combustion of the afterburning, one then ascertains for each working point, in a defined angle range before the beginning of injection of the afterburning, parameters C (constants) and m (polytropic exponent) of a polytropic model, using the method of least squares. The following applies:

$$p_{diff,poly} = \frac{C}{V(\varphi)^m}$$

where $V(\phi)$ corresponds to the volume of the combustion chamber that is a function of the crankshaft angle.

Figure 6:
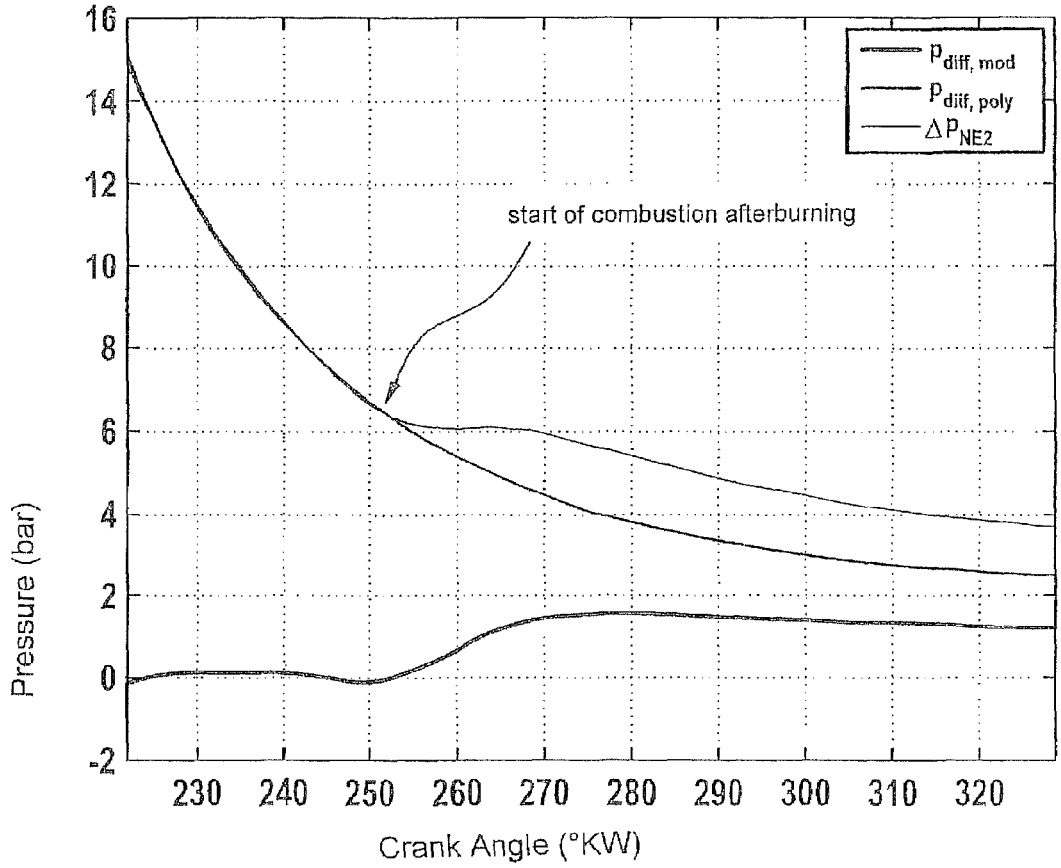
FIG. 6 shows temporal curves of the modeled and measured differential pressures for determining the start of combustion of an associated post-injection.

The start of combustion of the postinjection may now be determined from the differential pressure $\Delta p_{NE2} = p_{meas} - p_{diff,mod}$ (step S9) and the comparison of differential pressure $\Delta p_{NE2}$ to a specified postinjection threshold value (step S10). FIG. 6 shows the curves of the differential pressures $\Delta p_{NE2}$, $p_{diff,mod}$, $p_{diff,poly}$.

As a variant, one may again utilize the described iterative least square algorithm for the later fine adjustment of the estimate Of $p_{diff,poly}$. The following applies:

$$p_{diff,poly*} = \hat{\gamma}_1 p_{diff,poly} + \hat{\gamma}_2$$

where $\hat{\gamma}_1$ and $\hat{\gamma}_2$ are correction parameters as a result of the least squares algorithm.

With the aid of curve curvature $\kappa(\phi)$, one may also detect the first start of combustion in time, that is, for example, the start of combustion of a precombustion. As shown, for example, in FIG. 5, a clearcut curvature maximum occurs, as a rule, in the range of the point in time of the first pressure change. As an advantage, it may be utilized, in this instance, that the curvature $\kappa(\phi)$ is relatively uninfluenced by smaller errors in the estimation of the differential pressure curve. However, several local maxima are able to occur in the range of the precombustion, since the curvature corresponds to a function of the first and the second derivative of the differential pressure curve, and may accordingly be influenced by interferences in the pressure curve.

Furthermore, at operating points having two-step implementation of the pilot injections, as a rule, two distinct local maxima occur in the precombustion angle range (the crankshaft angle range in which the precombustions occur).

Moreover, at working points having very low conversion of the precombustion, the local maximum of the curvature in the range of the precombustion may not be unequivocal in each case.

Therefore, for the more accurate determination of times of start of combustion of the precombustion, a comparison may be made of the measured cylinder pressure to an absolute pressure threshold value corresponding to the adjusted compression pressure model, in order to determine an angular value at which a significant pressure increase has already been detected. Subsequently a search is made of the local maximum of the curvature in close vicinity of the angular value ascertained, for instance, in the range of ±100 crankshaft angle about the ascertained angular value.

Instead of using the differential pressure curve, one may also calculate curvature $\kappa(\phi)$ directly for overall pressure curve $p_{meas}$, to determine the start of combustion of the main combustion. Compared to the curvature calculation, the start of combustion of the main combustion is detected from the differential pressure ca. 1° crankshaft angle later, according to tendency, which is to be clarified by the influence of the compression pressure. However the ascertainment of the maximum of curvature $\kappa(\phi)$ of overall pressure curve $p_{meas}$ is a very simple and robust possibility of detecting the start of combustion.

This procedure may also be used for increasing the robustness while ascertaining the start of combustion with the aid of curvature $\kappa(\phi)$. In this context, the start of combustion of the main combustion is additionally calculated from the overall pressure curve and utilized as a substitute value, if the value calculated from the differential pressure should be greater.

What is claimed is:

1. A method for determining a point in time of a start of combustion in a cylinder of an internal combustion engine, comprising:

providing a base compression pressure model defining a curve of a compression pressure in the cylinder as a function of an operating point;

providing an adjusted compression pressure model by adjusting the base compression pressure model using measured cylinder pressures of at least one operating state of the internal combustion engine at points in time at which no combustion is taking place in the cylinder; and determining a point in time of a start of combustion with the aid of a pressure curve defined by the adjusted compression pressure model.

2. The method as recited in claim 1, further comprising:

using the pressure curve defined by the adjusted compression pressure model in a threshold value comparison as a function of a threshold value to determine a point in time of a start of combustion in the cylinder.

3. The method as recited in claim 2, wherein an adjusted differential pressure curve is ascertained as a difference between the curve of the measured cylinder pressure and a compression pressure curve determined by the adjusted compression pressure model, and the adjusted differential pressure curve is used in the threshold value comparison.

4. The method as recited in claim 3, wherein a point in time of a start of pre-combustion is determined by comparing the adjusted differential pressure curve to a pre-combustion threshold value.

5. The method as recited in claim 4, wherein the point in time of the start of pre-combustion is ascertained as a local maximum of a curvature in the adjusted differential pressure curve, the local maximum being ascertained starting from a point in time of the reaching of the pre-combustion threshold value by the differential pressure curve.

6. The method as recited in claim 2, wherein a point in time of a start of main combustion in the cylinder of the internal combustion engine is ascertained by determining a maximum of one of a curvature in the adjusted differential pressure curve, a pressure curve determined by the adjusted compression pressure model, or the curve of the measured cylinder pressures.

7. The method as recited in claim 6, wherein the point in time of the global maximum of the curvature in the curve of the measured cylinder pressures is determined as the point in time of the start of main combustion.

8. The method as recited in claim 7, wherein a point in time of the start of after-burning in the cylinder of the internal combustion engine is determined by comparing a differential pressure curve to a specified after-burning threshold value, wherein the differential pressure curve defines the difference between the curve of the measured cylinder pressures and a curve of the cylinder pressures according to a polytropic model.

9. The method as recited in claim 8, wherein an adjusted polytropic model is provided by adjusting the polytropic model using the measured cylinder pressures in at least one operating state of the internal combustion engine at points in time at which the combustion in the cylinder has terminated, and wherein the differential pressure curve is ascertained with the aid of a curve of the cylinder pressures according to the adjusted polytropic model.

10. The method as recited in claim 8, wherein the base compression pressure model is adjusted using the measured cylinder pressure curve at the at least one operating state of the internal combustion engine by taking into account, by using a selection matrix, only cylinder pressures at the points in time at which no combustion is taking place in the cylinder, and at the points in time at which the differential pressure, determined from the measured cylinder pressure and the compression pressure determined by the adjusted compression pressure model, is less than a differential pressure threshold value.

11. The method as recited in claim 10, wherein the base compression pressure model corresponds to an overrun pressure model describing the pressure curve in the cylinder during an overrun operation.

12. A device for determining a point in time of a start of combustion in an internal combustion engine, comprising:

means for providing a base compression pressure model defining a curve of a compression pressure in a cylinder of the internal compression engine as a function of an operating point;

means for providing an adjusted compression pressure model by adjusting the base compression pressure model using measured cylinder pressures of at least one operating state of the internal combustion engine at points in time at which no combustion is taking place in the cylinder; and means for determining a point in time of a start of combustion in the cylinder with the aid of a pressure curve defined by the adjusted compression pressure model.

13. A non-transitory computer-readable storage medium storing a computer program having a plurality of codes which, when executed on a computer, performs a method for determining a point in time of a start of combustion in a cylinder of an internal combustion engine, the method comprising:

providing a base compression pressure model defining a curve of a compression pressure in the cylinder as a function of an operating point;

providing an adjusted compression pressure model by adjusting the base compression pressure model using measured cylinder pressures of at least one operating state of the internal combustion engine at points in time at which no combustion is taking place in the cylinder; and determining a point in time of a start of combustion with the aid of a pressure curve defined by the adjusted compression pressure model.

* * * * *